US009957961B2

(12) United States Patent
Marchand et al.

(10) Patent No.: US 9,957,961 B2
(45) Date of Patent: May 1, 2018

(54) CONCENTRIC ROTARY FLUID MACHINE

(71) Applicant: Greystone Technologies Pty. Ltd., Welshpool (AU)

(72) Inventors: Nicholas Ryan Marchand, Edmonton (CA); Jeffery Ronald Clausen, Houston, TX (US)

(73) Assignee: GREYSTONE TECHNOLOGIES PTY. LTD., Welshpool (AU)

( * ) Notice: Subject to any disclaimer, the term of this patent is extended or adjusted under 35 U.S.C. 154(b) by 194 days.

(21) Appl. No.: 14/911,771

(22) PCT Filed: Aug. 12, 2014

(86) PCT No.: PCT/AU2014/000802
§ 371 (c)(1),
(2) Date: Feb. 12, 2016

(87) PCT Pub. No.: WO2015/021496
PCT Pub. Date: Feb. 19, 2015

(65) Prior Publication Data

US 2016/0201668 A1 Jul. 14, 2016

Related U.S. Application Data

(60) Provisional application No. 61/864,752, filed on Aug. 12, 2013.

(51) Int. Cl.
*F01C 1/32* (2006.01)
*F01C 19/02* (2006.01)
(Continued)

(52) U.S. Cl.
CPC ..... *F04C 15/0007* (2013.01); *F01C 1/322* (2013.01); *F01C 1/40* (2013.01);
(Continued)

(58) Field of Classification Search
CPC .. F01C 1/322; F01C 1/40; F01C 19/02; F01C 21/0809; F01C 21/0836; F01C 21/106;
(Continued)

(56) References Cited

U.S. PATENT DOCUMENTS 3,912,429 A 10/1975 Stevenson
4,446,829 A 5/1984 Yeager
(Continued)

FOREIGN PATENT DOCUMENTS

CN 101054974 A 10/2007
DE 20306866 U1 7/2003
(Continued)

OTHER PUBLICATIONS

European Search Report dated Jun. 20, 2017, for European Application No. 14836650.3 (10 p.).
(Continued)

*Primary Examiner* — Mark Laurenzi
*Assistant Examiner* — Dapinder Singh
(74) *Attorney, Agent, or Firm* — Conley Rose, P.C.

(57) ABSTRACT

A concentric rotary fluid machine includes a first body and a second body that are rotatable relative to each other and coaxially arranged one inside the other. A plurality of gates are supported by the second body in gate pockets. Each gate pocket includes: a gate retention recess that receives a gate cylinder of a gate; a gate seal recess that receives a sealing portion of a gate; and an intervening land. The sealing portion is configured to reciprocate up and down within a corresponding gate seal recess while maintaining contact with the recess and the second body. A plurality of lobes on the first body cause the gates to swing about respective swing axes as the first body rotates relative to the second
(Continued)

body. The lobes and the lands are configured so that a lobe forms a substantial seal against a land when in mutual radial alignment.

21 Claims, 5 Drawing Sheets

(51) Int. Cl.

| | |
|---|---|
| ***F04C 2/32*** | (2006.01) |
| ***F04C 15/00*** | (2006.01) |
| ***F04C 18/32*** | (2006.01) |
| ***F04C 27/00*** | (2006.01) |
| ***F04C 2/356*** | (2006.01) |
| ***F04C 11/00*** | (2006.01) |
| ***F01C 1/40*** | (2006.01) |
| ***F01C 21/08*** | (2006.01) |
| ***F01C 21/10*** | (2006.01) |

(52) U.S. Cl.
CPC ..... *F01C 19/02* (2013.01); *F01C 21/0809* (2013.01); *F01C 21/0836* (2013.01); *F01C 21/106* (2013.01); *F01C 21/108* (2013.01); *F04C 2/322* (2013.01); *F04C 2/3566* (2013.01); *F04C 11/001* (2013.01); *F04C 18/322* (2013.01); *F04C 27/001* (2013.01)

(58) Field of Classification Search
CPC .... F01C 21/108; F04C 11/001; F04C 18/322; F04C 2/322; F04C 2/3566; F04C 27/001
USPC ..... 418/140, 147, 152
See application file for complete search history.

(56) References Cited

U.S. PATENT DOCUMENTS

| | | | | |
|---|---|---|---|---|
| 4,715,338 | A * | 12/1987 | Pasquan | F01C 1/46 123/248 |
| 6,129,068 | A * | 10/2000 | Wingate, Jr. | F01C 1/46 123/248 |
| 6,280,169 | B1 | 8/2001 | Dyktynski et al. | |
| 6,468,061 | B2 | 10/2002 | Dyktynski et al. | |
| 6,939,117 | B2 | 9/2005 | Wheeler et al. | |
| 6,976,832 | B1 | 12/2005 | Wheeler et al. | |
| 2009/0114184 | A1 | 5/2009 | Wang | |
| 2010/0170469 | A1 | 7/2010 | Hudson | |
| 2013/0115121 | A1 | 5/2013 | Ozawa et al. | |

FOREIGN PATENT DOCUMENTS

| | | | |
|---|---|---|---|
| GB | 2292186 | A | 2/1996 |
| WO | 2013/006902 | A1 | 1/2013 |
| WO | 2013/159153 | A1 | 10/2013 |

OTHER PUBLICATIONS

PCT/AU2014/000802 International Search Report and Written Opinion dated Sep. 17, 2014 (18 p.).
PCT/AU2014/000802 International Preliminary Report on Patentability dated Jul. 6, 2015 (17 p.).
English Translation of Chinese Office Action dated Mar. 2, 2017, for Chinese Application No. 201480054285.5 (7 p.).

* cited by examiner

CONCENTRIC ROTARY FLUID MACHINE

CROSS-REFERENCE TO RELATED APPLICATIONS

This application is a 35 U.S.C. § 371 national stage application of PCT/AU2014/000802 filed Aug. 12, 2014 and entitled "A Concentric Rotary Fluid Machine," which claims benefit of U.S. provisional patent application Ser. No. 61/864,752 filed Aug. 12, 2013 and entitled "A Rotary Fluid Drive", which is hereby incorporated herein by reference in its entirety.

STATEMENT REGARDING FEDERALLY SPONSORED RESEARCH OR DEVELOPMENT

Not applicable.

TECHNICAL FIELD

The present disclosure relates in general to concentric rotary fluid machine such as a pump or a motor/drive.

BACKGROUND ART

Concentric rotary fluid machines may be operated as a pump or alternately as a motor/drive. When operated as a pump, external torque is provided to a rotating part of the machine which in turn provides positive displacement for fluid thereby providing a pumping action. When used as a drive, fluid is pumped through the machine causing one body or component to rotate relative to another thereby providing torque which may be used to drive a tool, mechanism, or system. Throughout this specification the term "fluid" is to be given its ordinary meaning and includes a liquid, gas, or other substance or composition that is able to flow and/or otherwise yields to pressure. Non limiting examples of a fluid include, water, oil, liquid air, liquid nitrogen and drilling muds.

Examples of a type of concentric rotary fluid machine to which the present disclosure relates are disclosed in U.S. Pat. Nos. 6,280,169; 6,468,061; 6,939,177; and, 6,976,832 (all of which are hereby incorporated by reference in their entirety). This type of machine has a rotor and a stator which are concentrically arranged one inside the other to define a working fluid space there between. One of the rotor and stator is provided with one or more lobes and the other is provided with or supports one or more gates or vanes. Whichever one of the rotor and stator supports the gate is sometimes referred to as the "supporting body" of the machine. The other is sometimes referred to as the "non-supporting body" of the machine. When the machine is used for example as a drive or a motor, a fluid is pumped through the machine, passes into the working fluid space through various inlets, and exits the working space through one or more outlets. A movable gate or vane is always maintained between the inlets and outlets to effectively divide the working chamber into alternating high pressure and low pressure chambers. The pressure of fluid entering through the inlets acts equally on all components within the working chamber and consequently has the effect of causing the rotor to rotate. This in turn progressively moves the gates or vanes relative to the outlets so that eventually the high pressure fluid is itself displaced to a rotationally adjacent outlet.

The efficiency of operation of such a machine, its ease of manufacture and susceptibility to failure is dependent on numerous factors including but not limited to: the design and configuration of the gates/vanes that extend into the working fluid space; the configuration of the recesses or slots into which the gates or vanes retract into when contacted by a passing lobe; the relative configuration and sealing efficiency of a lobe against the recess/slot; and friction between relatively moving components.

In a machine having one or more swinging gates, during relative rotation of the rotor and stator, when a gate is fully extended contact between a lobe and a gate initially occurs at a location adjacent a swing axis of the gate. As rotation continues, eventually the lobe contacts a distant free end of the gate. In order to create an effective seal the lobe and the gate must be formed with substantially matching curved surfaces to prevent high pressure from leaking between the gate and the lobe to an adjacent low pressure side when the lobe and the gate are in mutually radial adjacent relationship. This presents challenges in manufacture to produce components to high tolerance specifications not only to minimise this pressure leakage but also to facilitate the overall fit of the components that make up the machine.

SUMMARY OF THE DISCLOSURE

The present disclosure teaches a concentric rotary fluid machine having different design features that facilitate greater operational efficiency with increased ease of manufacture. One aspect of the disclosed machine is a gate and body configuration that enables the gate to seal at an end distant its swing axis against both the supporting body and the non-supporting body. A further aspect of the disclosed machine is a gate and body configuration that results in a lobe initially contacting a gate at an end distant the swing axis in order to retract the gate into a corresponding gate pocket. More particularly a leading ramp of a lobe contacts a sealing portion of a gate prior to passing a corresponding swing axis of the gate. As maybe understood by those skilled in the art this represents a gate swing direction directly opposite to that in at least the above mentioned prior art machines. In yet a further aspect there is disclosed a gate, gate pocket and lobe configuration that enables the lobe to form a seal against a supporting body of an associated machine at a location between the swing axis of the gate and the sealing portion of the gate distant the swing axis.

In a first aspect there is disclosed a concentric rotary fluid machine comprising:

first and second bodies, the bodies being coaxially arranged one inside the other to define a working chamber there between and wherein the bodies are rotatable one relative to the other about a rotation axis;

at least one gate supported by one of the first body and the second body wherein the body supporting the gate constitutes a supporting body and the body not supporting the gate constitutes a non-supporting body;

at least one lobe provide on the non-supporting body; and for each gate, a respective gate pocket formed on the supporting body;

each gate being supported in a manner to swing about a respective swing axis that lies parallel with the rotation axis, each gate having a sealing portion distant its corresponding swing axis, each gate pocket being configured to receive the sealing portion of a corresponding gate; the gate pockets, sealing portions and non-supporting body being relatively configured such that when the at least one gate is in an extended position the sealing portion of the at least one gate forms a substantial seal against both the gate pocket and the non-supporting body.

In one embodiment for each gate, the sealing portion is configured to always at least partially reside within a respective gate pocket during rotation of the bodies relative to each other.

In one embodiment the gate pocket comprises a gate retention recess through which the swing axis passes and a gate seal recess within which the gate seal always at least partially resides during rotation of the bodies relative to each other.

In one embodiment the supporting body comprises, for each gate pocket, a land located between the gate retention recess and gate seal recess.

In one embodiment each land and the non-supporting body are configured to form a substantial seal when a lobe is in radial alignment with a land.

In one embodiment each gate comprises a retention portion configured to be retained within the gate pocket and through which the swing axis passes and two or more arms that join the retention portion to a respective sealing portion wherein a space is created between the retention portion and the sealing portion.

In one embodiment each gate comprises a retention portion configured to be retained within the gate retention recess and two or more arms that join the retention portion to a respective sealing portion wherein a space is created between the retention portion and the sealing portion.

In one embodiment the land is accommodated within the space when a corresponding gate is in a retracted position with a lobe in radial alignment the land.

In one embodiment when the machine is operated as a motor the direction of rotation of a gate about a corresponding swing axis to retract the gate into the gate pocket from the extended position is the same as the direction of rotation of the non-supporting body relative to the supporting body about the rotation axis. However in an alternate embodiment when the machine is operated as a pump the direction of rotation of a gate about a corresponding swing axis to retract the gate into the gate pocket from the extended position is opposite to the direction of rotation of the non-supporting body relative to the supporting body about the rotation axis.

In a motor embodiment of the machine, with reference to a direction of rotation of the non-supporting body relative to the supporting body about the rotation axis, each gate is arranged so that a corresponding sealing portion is in advance of the swing axis such that a lobe passes the sealing portion of a gate before passing the swing axis of the gate. However in a pump embodiment of the machine, with reference to a direction of rotation of the non-supporting body relative to the supporting body about the rotation axis, each gate is arranged so that a corresponding sealing portion trails the swing axis such that a lobe passes the swing axis of a gate before passing the sealing portion of the gate.

In a second aspect there is disclosed a concentric rotary fluid machine comprising:

first and second bodies, the bodies being coaxially arranged one inside the other to define a working fluid space there between and wherein the bodies are rotatable one relative to the other about a rotation axis;

at least one gate supported by one of the first body and the second body wherein the body supporting the gate constitutes a supporting body and the body not supporting the gate constitutes a non-supporting body;

at least one lobe provide on the non-supporting body;

each gate being supported in a manner to swing about a respective swing axis that lies parallel with the rotation axis, each gate having a sealing portion distant its corresponding swing axis, each gate and the bodies being relatively configured such that when the at least one gate is in an extended position the sealing portion forms a substantial seal against both the supporting and non-supporting body and wherein the gates and lobes are arranged such that on relative rotation of the bodies: when the machine is operated as a motor, a leading ramp of the lobes contacts the sealing portion of the at least one gate prior to passing a corresponding swing axis of the at least one gate; and when the machine is operated as a pump, a leading ramp of the lobes passes the swing axis of the at least one gate prior to contacting a corresponding portion of the at least one gate.

In one embodiment the machine comprises a gate pocket formed in the supporting housing for each gate: and when operated as a motor the direction of rotation of a gate about a corresponding swing axis to retract the gate into the gate pocket from the extended position is the same as the direction of rotation of the non-supporting body relative to the supporting body about the rotation axis; but when operated as a pump, the direction of rotation of a gate about a corresponding swing axis to retract the gate into the gate pocket from the extended position is opposite the direction of rotation of the non-supporting body relative to the supporting body about the rotation axis.

In one embodiment each gate comprises a retention portion configured to be retained within the gate pocket and through which the swing axis passes and two or more arms that join the retention portion to a respective sealing portion wherein a space is created between the retention portion and the sealing portion.

In one embodiment each gate pocket comprises a retention recess in which the retention portion is received and a gate seal recess within which the gate seal always at least partially resides during rotation of the bodies relative to each other.

In one embodiment the supporting body comprises, for each gate pocket, a land located between the gate retention recess and gate seal recess.

In one embodiment each land and the non-supporting body are configured to form a substantial seal when a lobe is in radial alignment with a land.

In a third aspect there is disclosed a concentric rotary fluid machine comprising:

first and second bodies, the bodies being coaxially arranged one inside the other to define a working fluid space there between and wherein the bodies are rotatable one relative to the other about a rotation axis;

at least one gate supported by one of the first body and the second body wherein the body supporting the gate constitutes a supporting body and the body not supporting the gate constitutes a non-supporting body;

at least one lobe provided on the non-supporting body;

each gate having a retention portion, and a distant sealing portion, the supporting body being provided with a gate pocket for each gate, each gate pocket having a retention recess for receiving the retention portion of a gate and a seal recess for receiving the sealing portion of the same gate and a land between the retention portion and the sealing portion; the lobes and lands being configured to form a substantial seal against each other when in mutual radial alignment.

In one embodiment each gate comprises two or more arms that join the retention portion to a respective sealing portion wherein a space is created between the retention portion and the sealing portion.

In one embodiment of the machine, for each gate pocket, the land is accommodated within the space when a corresponding gate is in a retracted position with a lobe in radial alignment to the land.

In one embodiment of each or any of the above aspects each lobe is sufficiently wide to form a substantial seal with a circumferential surface of the supporting body facing the working chamber across at least one of the seal recess and the retention recess.

In an alternate embodiment of each or any of the above aspects each lobe is sufficiently wide to form a substantial seal with a circumferential surface of the supporting body facing the working chamber across both of the gate seal recess and the gate retention recess at one particular instant in time.

In one embodiment of each or any of the above aspects each lobe has a profile that is symmetrical about a radial center line of the lobe. However in an alternate embodiment of each or any of the above aspects each lobe has a profile that is asymmetrical about a radial center line of the lobe In one embodiment of each or any of the above aspects each gate pocket is provided with at first slot configured to provide clearance for the sealing portion of a corresponding gate to allow over-travel of each gate when contacted by a lobe.

BRIEF DESCRIPTION OF THE DRAWINGS

Notwithstanding any other forms which may fall within the scope of the apparatus as set forth in the Summary, specific embodiments will now be described, by way of example only, with reference to the accompanying drawings in which.

DETAILED DESCRIPTION OF SPECIFIC EMBODIMENTS

Figure 1:
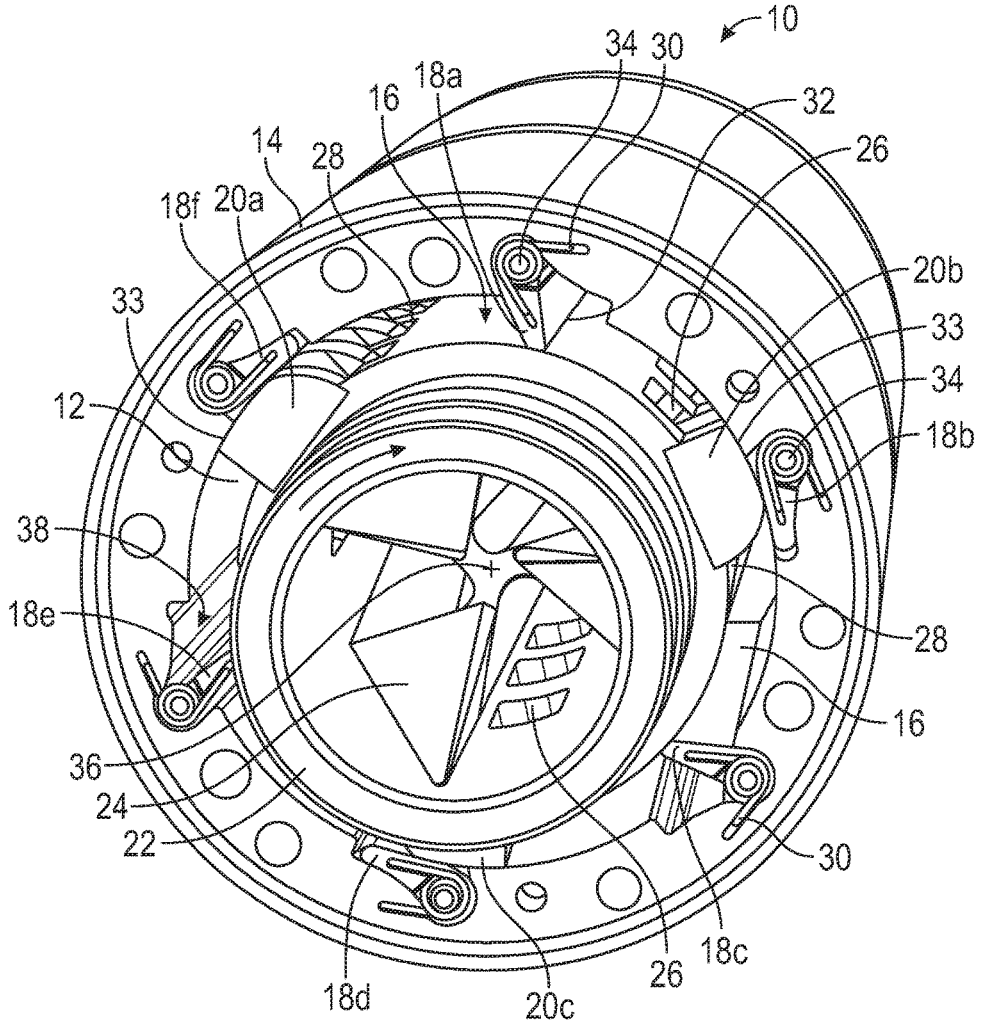
FIGURE 1 (Prior Art)
FIG. 1 is a representation of a prior art concentric rotary fluid machine.

To provide context to and a comparative basis for the presently disclosed machine reference is made to FIG. 1 depicting a prior art machine. This prior art machine is described in U.S. Pat. No. 6,976,832. In brief the machine 10 of FIG. 1 comprises a first body 12 and a second body 14. The first body 12 is concentric with and disposed inside of the second body 14. An annular working chamber 16 is formed between the inner body 12 and the outer body 14. The outer body supports a plurality (six) gates 18*a*-18*f*, the inner body 12 on the other hand supports a plurality (in this case three) lobes 20*a*-20*c*. The inner body 12 comprises an axial conduit 22 in which is disposed a manifold 24. A plurality of inlet ports 26 and outlet ports 28 are formed in the conduit 22 to provide fluid communication between the conduit 22 and the working chamber 16. The gates 18 are biased by springs 30 toward an extended or sealing position in which a sealing portion 32 of each gate 18 contacts or is in close proximity to an outer circumferential surface of the body 12. The sealing portion is at an end of a gate 18 distant the swing axis 18. Further the sealing portion 32 when in an extended position contacts or lies in close proximity to the body 12 only. The gates 18 are able to swing about respective swing axes 34. The swing axes 34 are parallel to a rotation axis 36 about which one of the bodies 12, 14 rotates about the other.

The body 14 is provided with a gate pocket 38 for each of the gates 18. The gate pockets 38 and gates 18 are relatively configured so that when a gate 18 is moved to its retracted position it is able to retract sufficiently into the body 14 to enable a contacting lobe 20 to pass thereby. Further, the surface of the gate 18 and surface of a contacting passing lobe 20, (for example see gate 18*b* and lobe 20*b*) are relatively shaped so as to form a substantial seal there between.

In the machine 10 either one of the bodies 12 and 14 can act as the stator and the other as the rotor. Similarly, the relative disposition of the lobes and gates can be changed so that the gates are supported on the inner body 12 and the lobes supported on the outer body 14. To accommodate for this interchangeability in relation to which body supports the gates and the lobes and which body rotates relative to the other, the body that supports the gates will be designated as the supporting body and the other body will be designated as the non-supporting body. Thus in FIG. 1 the body 14 is the supporting body and the body 12 is the non-supporting body.

When the machine 10 is operated as a motor or drive, high pressure fluid is supplied to one end of the conduit 22. The high pressure fluid is evenly divided by the manifold 24 to flow through the inlets 26 and into the working chamber 16. This fluid exerts pressure against both the gates 18 and the lobes 20 on either side of the inlets 26. In the event that the supporting body 14 is held stationary, this will result in the non-supporting body 12 being rotated in a clockwise direction. Consequently, the lobes 20 will approach the gates 18 in the direction of rotation so as to contact the gates 18 initially at a location near their respective swing axes 34 and subsequently pass by the free ends 32 which will be retracted into the gate pockets 38. A circumferential tip surface 33 of a lobe 20 passes the swing axis 34 before it passes the sealing portion 32 of the gate 18. As the body 12 rotates eventually the high pressure fluid will come into communication with the outlet ports 28 resulting in the fluid being vented back into the conduit 22 to flow out of the machine 10.

FIGS. 2-10 illustrate an embodiment of the concentric rotary fluid machine and components thereof in accordance with the present disclosure. The concentric fluid rotary machine 100 (herein after referred to in general as "machine 100") comprises a first body 102 and a second body 104. The bodies 102, 104 are coaxially arranged one inside the other. In this instance, the first body 102 is disposed inside the second body 104. The arrangement of the bodies 102, 104 defines or otherwise forms a working chamber 106 between the bodies. As will be explained in greater detail hereafter, the working chamber 106 is divided into alternating high and low pressure chambers. The bodies 102 and 104 are further arranged so that they are rotatable one relative to the other about a rotation axis 108.

It is immaterial to the general principals of operation of a machine 100 which of the bodies 102 and 104 is stationary and which one rotates. This is determined by the desired application of the machine 100. For example, if the machine 100 were to be used in a directional drill of a type described in Applicant's international application no. PCT/AU2013/000432 the outer of the body 104 is stationary and the inner body 102 rotates. Moreover in such an application the machine 100 is operated as motor or drive and the inner body rotates in the clockwise direction. For ease of description in the present embodiment it will be assumed that the body 104 is stationary (i.e. constitutes a stator) and that the inner body 102 rotates (i.e. constitutes a rotor).

At least one, (and in the present embodiment six) gates 110*a*-110*f* (hereinafter referred to in general as "gates 110") are supported by one of the first and second bodies 102, 104 and in this particular embodiment the second body 104. For convenience, the second body 104 will be hereinafter referred to as the "supporting body". Following from this, the first body 102 which does not support the gates 110 will be hereinafter referred to as the "non-supporting body 102".

At least one, (and in this embodiment three) lobes 112*a*-112*c* (hereinafter referred to in general as "lobes 112") are provided on the non-supporting body 102. The lobes 112 are evenly spaced about the outer circumferential surface of the non-supporting body 102. Each lobe 112 has a circumferential tip surface 113 and opposite leading and trailing ramps 115 and 117. In the illustrated embodiment each lobe 112 is asymmetric about a radial line 119 passing midway through the arc of the tip surface 113. In this embodiment this optimizes efficiency for the designed rotational direction of the non-supporting body 102 while also allowing for counter rotation in some operational circumstances. The circumferential tip surface 113 is relatively wide in a circumferential direction. This minimizes leakage and pressure loss across the gates and gate pockets during operation.

Each of the gates 110 is supported in the supporting body 104 in a manner to swing along a respective swing axis 114*a*-114*f* (hereinafter referred to in general as "swing axis 114" in the singular, or "swing axes 114" in the plural). The swing axes 114 lie parallel to the rotation axis 108.

The non-supporting housing 102 is provided with a plurality of inlet ports 116 and outlet ports 118. The non-supporting body 102 is also provided with an inlet flow path Fi and an outlet flow path Fo which are co-axial with each other but fluidically isolated from each other within the body 102. In this instance, the isolation is provided by a wall portion 120 of the body 102 that physically isolates a downstream end of the inlet flow path Fi from an upstream end of the outlet flow path Fo.

The inlet ports 116 are formed radially in the body 102 to provide fluid communication between the fluid inlet flow path Fi and the working chambers 106. The outlet ports 118 are also formed radially of the body 102 and provide fluid communication between the working chambers 106 and the fluid outlet path Fo.

The working chamber 106 is in effect an annular chamber which is segmented into three portions by the lobes 112 which form substantial seals against an inner circumferential surface of the supporting body 104. Further, the segmented working chamber 106 extends in an axial direction between opposite ends of the machine 100.

The number of lobes 112 and the number of gates 110 can vary. However, in embodiments of the machine 100 there is at least one fluid inlet port 116 and at least one fluid outlet port 118 between adjacent lobes 112 at any given time, and at least one gate 110 forming a substantial seal between rotationally adjacent inlet and outlet ports at any given time. As a consequence of this, the working chamber 106 is in effect divided into alternating high and low pressure chambers 122*a*, 124*a*; 122*b*, 124*b*; and 122*c*, 124*c*. It will be appreciated by those skilled in the art that as the bodies 102 and 104 rotate relative to each other the volumes of the high and low pressure chambers vary cyclically from zero to maximum volume.

Figure 5:
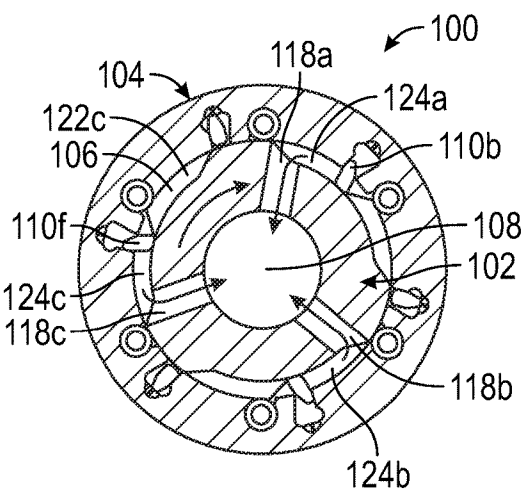
FIG. 5 is a view of section B-B of the machine shown in FIG. 2.

The high pressure chambers 122*a*-122*c* (hereinafter referred to in general as "high pressure chambers 122") constitute the portions of the working chamber 106 that are in fluid communication with respective inlet ports 116 and bound by the lobe 112 corresponding to that inlet port, and a fluidically adjacent gate 110. Each low pressure chamber 124*a*-124*c* (hereinafter referred to in general as "low pressure chambers 124") is created in respective parts of the working chamber 106 which are in fluid communication with respective outlet ports 118 and bound on opposite sides by a corresponding adjacent lobe 112 and a fluidically adjacent gate 110. For example, with reference to FIG. 4, a high pressure chamber 122*a* exists in the working space 106 which is fed by inlet port 116*a* and bound on either side by the lobe 112*b* and the gate 110*b*. With reference to FIG. 5, the low pressure chamber 124*a* exists in the part of the working chamber 106 in fluid communication with the outlet port 118*a* and bound on either side by the lobe 112*a* and the gate 110*b*.

Figure 2:
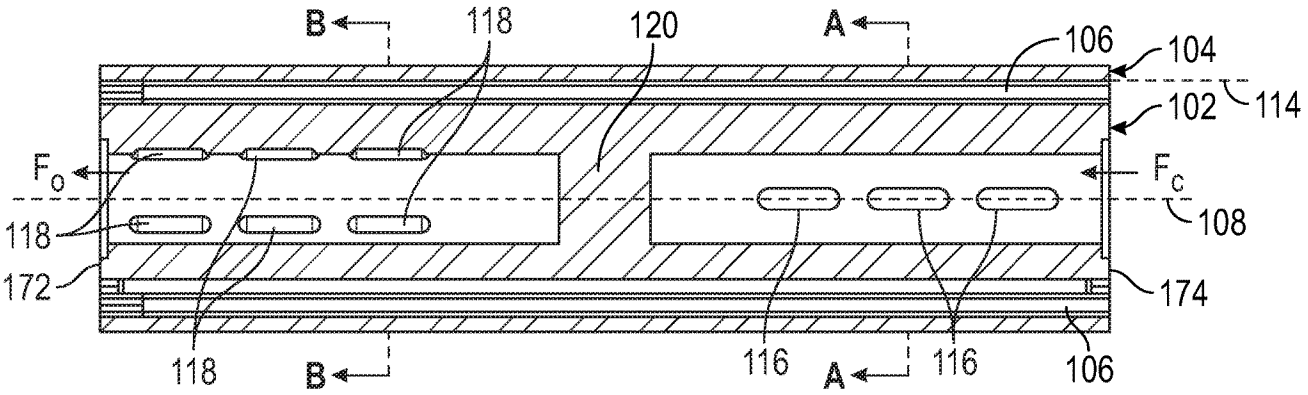
FIG. 2 is a longitudinal section view of one embodiment of the presently disclosed concentric rotary fluid machine.

The general operation of the machine 10 is as follows. High pressure fluid is supplied to the inlet flow path Fi. With reference to FIG. 2, this is equivalent to high pressure fluid being presented from the right hand side and flowing generally towards the left hand side. The high pressure fluid is communicated via respective inlet ports 116 into the respective high pressure chambers 122. In the high pressure chambers 122 the pressure of the fluid acts in all directions and thus exerts pressure on both the lobe 122 and the gate 110 of the respective high pressure chamber 122. In this embodiment, the supporting housing 104 is fixed. Thus this pressure results in a rotation of the non-supporting body 102 in a clockwise direction.

It will be appreciated with reference to FIG. 5, as the non-supporting body 102 rotates in the clockwise direction eventually the outlet port 118*c* will pass the gate 110*f* and thus form an outlet port for the fluid within the high pressure chamber 122*c* thereby converting that chamber into a low pressure chamber 124. It will also be appreciated that there is no direct communication between the inlet port 116*c* as this is now rotated in a clockwise direction and is isolated from the outlet port 118*c* by the gate 110*a* which has now moved to the extended position forming a substantial seal against the smaller diameter portion of the non-supporting body 102 behind the inlet port 116*c*. The fluid passing through the outlet ports 118 subsequently flows into the fluid outlet path Fo and axially out of the machine 100.

The configuration of the gates 110, supporting housing 104 and non-supporting housing 102 will now be described in greater detail.

Figure 8:
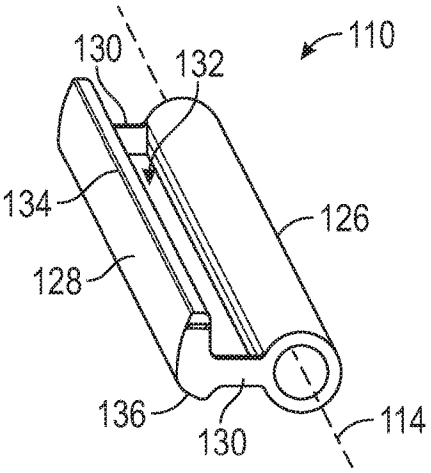
FIG. 8 is a perspective view of a gate incorporated in the machine shown in FIG. 2.
Figure 10:
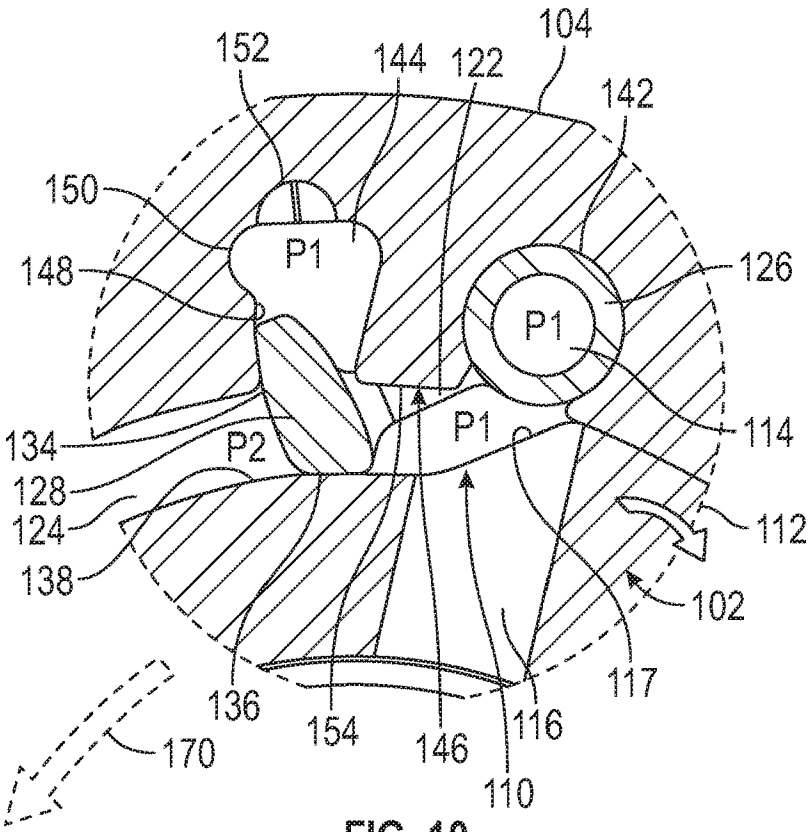
FIG. 10 is a parallel section view of the portion of the machine shown in FIG. 9.
Figure 9:
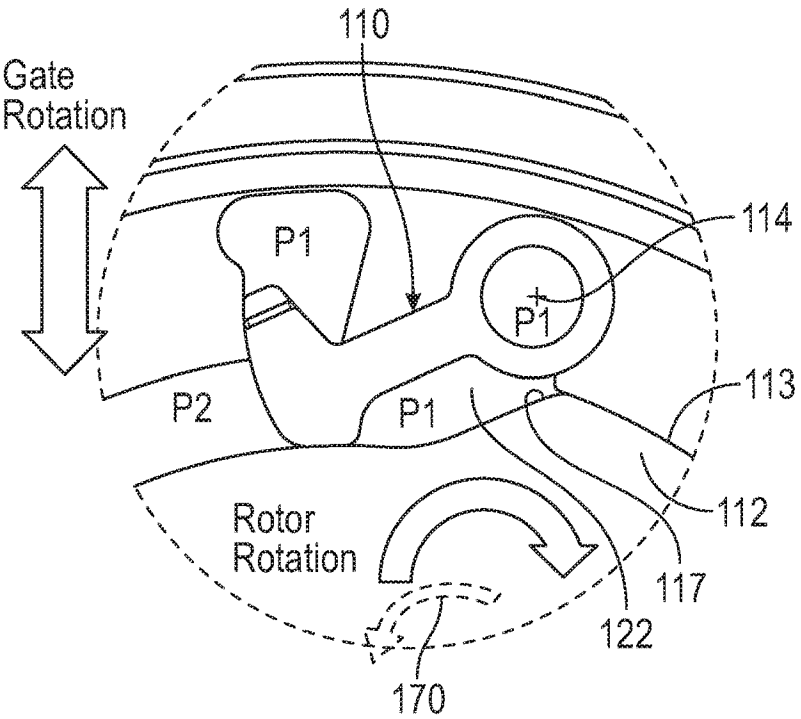
FIG. 9 is an enlarged view from one end of a portion of the machine shown in FIG. 2 illustrating the structural relationship between the outer body of FIG. 6, the inner body of FIG. 7, and the gate of FIG. 8.

With particular reference to FIGS. 8-10, each gate 110 comprises a retention portion in the form of an elongated gate cylinder 126 and a sealing portion 128. A central axis of the cylinder 126 coincides with the swing axis 114 of the gate 110. The sealing portion 128 is coupled to the retention portion 126 by way of spaced apart arms 130. This creates a space or void 132 between the cylinder 126, sealing portion 128, and the arms 130.

The sealing portion 128 is configured to form a seal when in the extended position with both the supporting housing 104 and the non-supporting 102. To this end the sealing portion 128 has a first sealing surface 134 configured to form a substantial seal with the supporting housing 104; and a second contiguous sealing surface 136 configured to form a seal against constant diameter outer circumferential surface portions 138 of the non-supporting housing 102. The first surface 134 is convexly curved. The second surface 136 may be formed with a slight concave curvature to match that of the surface portions 138 of the body 102; or alternately may be formed with a generally planar surface; or alternately may be formed with a slight convex curvature to provide minimal friction against the body 102.

The supporting body 104 is formed with a gate pocket 140 for each gate 110. Each gate pocket 140 comprises a gate retention recess 142, a gate seal recess 144 and an intervening land 146. The land 146 is formed on a free circumferential face of a corresponding radial projection 147 between the recesses 142 and 144 of a gate pocket 140. In effect the land 146 forms part of the inner surface of the supporting body 104. The retention recess 142 is configured to receive a corresponding gate cylinder 126. In particular, the retention recesses 142 have a substantially circular cross sectional shape and form a bearing surface for the cylinders 126. Further, the retention recesses 142 are configured to contact a corresponding gate cylinder 126 for a substantial portion of the circumference of the cylinder 126, for example at least more than 180°, such as about 200° and preferably between about 200° and 300°. In the present embodiment the recess 142 and cylinder 126 are in contact for about 270°.

The sealing portion 128 reciprocates up and down within a corresponding gate seal recess 144 as the gate 110 swings in opposite directions about its swing axis 114. Each gate seal recess 144 has a radially extending sealing surface 148 that is formed with a slight concave curvature of substantially the same radius as the curvature of the surface 134. The surfaces 134 and 148 are thus complementary and shaped to form a substantial seal there between as the sealing portion 128 reciprocates within its gate seal recess 144.

Debris slots 150 and 152 are formed in the gate seal recesses 144 to allow debris that may be entrained in the fluid driving the machine 100 to move out of the way of a retracting gate seal 128. This minimises the risk of a gate 110 jamming or being held partially outside of a corresponding recess 144 as a lobe 112 passes thereby. Such debris is not uncommon in various possible applications of the machine 100 including for example as a drive in a mud motor of a down the hole directional drill.

The debris slot 152 also provides additional clearance for the sealing portion 128 of a corresponding gate 110 to allow sufficient over-travel of the gate during its reciprocation should debris or other foreign material pass between the gate 110 and the rotor/non supporting body 102. This over-travel allows for significant debris to pass through an interface region between the gate 110 and body 102 including the lobes 112 without locking up the machine 100 should matter become stuck or jammed between the body 102 and the gate 110. This also allows manufacturing tolerances on the sealing portion 128 of the gate to be looser in relation to its height. To the inventors' best knowledge the prior art does not allow this over-travel of the gates travel due to the requirement of close fit matching surfaces to maintain constant rotation of the machine. If debris/material were jammed in this area in prior art machines they are very likely to lock up. The risk of this is substantially alleviated for the machine 100 due to the above described features.

The sealing portion 124 is always at least partially retained within the gate seal recess 144. Also, as shown in FIG. 10, each land 146 extends into the space 132 between the gate cylinder 126 and sealing portion 128 of a corresponding gate 110. The land 146 has a surface 154 facing into the working chamber 106. The surface 154 is configured to form a substantial seal against a circumferential tip surface 113 of a passing lobe 112. Further the circumferential tip surface 113 is sufficiently wide to form a substantial seal with the circumferential surface of the supporting body 104 facing the working chamber across either one of the gate seal recess 144 or the gate retention recess 142. It is further envisaged in some embodiments that the circumferential tip surface 113 is sufficiently wide to form a substantial seal with the a circumferential surface of the supporting body 104 facing the working chamber across both of the gate seal recess 144 and the gate retention recess 142 at one particular instant in time.

Moreover the circumferential tip surface of the lobe is arranged to form a substantial seal against the facing surface of the supporting body 104.

FIG. 10 depicts a gate 110 in an extended position shortly after the passage of a trailing edge of a lobe 112 which is moving in the clockwise direction relative to the body 104. The inlet port 116 is marginally in advance of the sealing portion 128. Thus high pressure fluid is now entering the working chamber forming a high pressure chamber 122. On a trailing or left hand side of the sealing portion 128 the working chamber is in communication with an outlet port (not shown) and therefore forms a low pressure chamber 124. The high pressure fluid loads the gate 110 primarily to the left and into the supporting body 104. In comparison with say gate 18*a* of the prior art machine 10 shown in FIG. 1, the high pressure fluid flowing through inlet 26 adjacent lobe 20*b* acts to load the gate 18*a* in a radial direction and into a corresponding gate retention recess in the body 14 which may cause binding and high friction. Embodiments of the current machine 100 with the exemplified gate 110 and supporting body 104 substantially increases (in some instances more than doubles) the load bearing areas that the gate 110 can react to the supporting body 104 during operation.

The gates 110 are provided with biasing means for biasing the gates toward an extended position corresponding to a direction in which the sealing portion 128 is urged toward the outer circumferential surface of the non-supporting body 102. Such biasing means may comprise torsion rod springs that extend into and couple with the gate cylinders 126; torsion coil springs; cam bodies; fluid pressure; magnets, or any other suitable mechanical or hydraulic means.

The lobes 112 are of a width so as to be able to substantially span a gate pocket 140. Further, each lobe 112 is of a width so as to be able to form a substantial seal initially across a gate seal recess 144 between the land 146 and a portion of the surface of the supporting housing 104 on an opposite side of the gate seal recess 144; and subsequently form a seal across a gate retention recess 142 between the land 146 and an adjacent portion of the inner surface of the supporting body 104 on an opposite side of the recess 142.

With particular references to FIGS. 3-5 and 9-10 it should be understood that when the machine 100 is in use with the supporting body 104 stationary and the non-supporting body 102 rotating, the lobes 112 approach the gates 110 in an opposite direction to that in the prior art. In the current embodiments of the machine 100, with reference to the direction of rotation of the rotating body (the non supporting body 102), the sealing portion 128 of each gate 110 is rotationally in advance of the corresponding swing axis 114. Thus for normal operation of the machine 100 upon rotation of the body 102, the lobe 112 initially contacts a gate 110 at a location in advance of the corresponding swing axis 114. In comparison with the prior art machine 10 of FIG. 1, the lobes 20 approach and contact the gates 18 at a location trailing or behind the corresponding swing axis 34. More generally for the machine 100 the circumferential tip surface 113 of a lobe 112 passes the sealing portion 128 before passing the swing axis 114 irrespective of whether the relative rotation of the bodies 102 and 104 is provided by (a) the body 102 rotating clockwise and the body 104 being stationary; or equivalently (b) the body 104 rotating counter clockwise and the body 102 being stationary. This is directly opposite to the operation of the prior machine 10 where the equivalent surface of lobe 20 passes the swing axis 18 before passing the sealing portion of the gate 18. An alternate way of describing this operational characteristic is in terms of the leading ramp 115 of a lobe 112. The leading ramp 115 of a lobe will contact the sealing portion 128 of a gate 110 prior to passing a corresponding swing axis 114 of that gate.

Notwithstanding the above, the configuration of the body 102/lobes 112 and gates 110 allows rotation in either direction when the machine 100 is used as a pump or motor. That is, the relative rotation between the bodies 102 and 104 can be reversed from the normal or natural direction operational direction. This feature is particularly useful in the event that the machine 100 stalls while being driven by an outside or up-hole motor or torque transmitting device (e.g. a top drive/rotary table). The up-hole motor can overpower the rotary machine 100 and cause the body 102 to thus change direction relative to 104 during operation (motor stall). The machine 100 is not required to perform its intended function (e.g. as a motor or a pump) during this event but must allow rotation of body 102 in both directions without causing a failure or binding of the parts. To the best of the inventors' knowledge this functionality is not mentioned in or possible with the geometry of the machines in at least the prior art. Clearly in the prior machine 10 rotating the rotor 12 in an anticlockwise direction will result in jamming and/or breaking of the gates 18.

Figure 3:
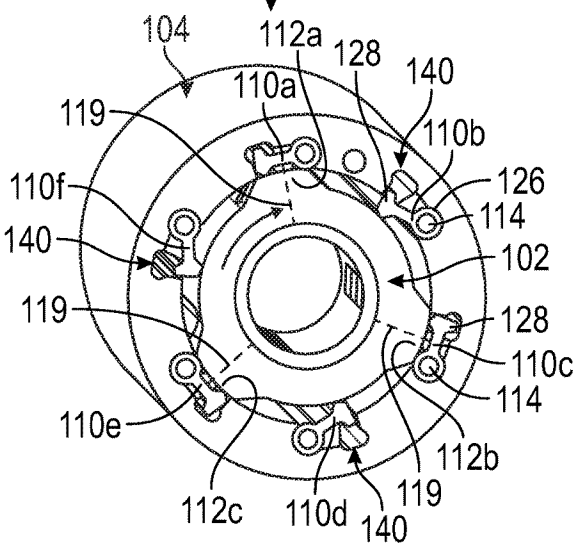
FIG. 3 is an end view of the machine shown in FIG. 2.

It will be noted in particular from FIG. 3 that when a gate 110 is in a fully retracted position there is a very small contact area between the lobe 112 and the gate 110. The contact is in essence limited to a portion of the surface 136 of the gate seal 128 and the surface 156 of the lobe 112. This should be contrast with the corresponding situation in the prior art machine shown in FIG. 1. In order to form a seal in the prior art machine 10 it is necessary for the surface of the gate 18 and the surface of the lobe 20 in contact with the gate to have complementary profiles. This makes the manufacture including the machining of the machine 100 substantially easier than in the prior art. In particular, the overall manufacturing tolerance in the machine 100 can be loosened as the inner diameter of the non-supporting body 102 is defined only by the dimensions of the body 102 itself and not a stack up of the gate and lobes 112.

Further the addition of the land 146 allows for the lobes 112 of the body 102 to have a constant bearing inner diameter to act against. In this way the bodies 102 and 104 act as bearing members themselves. To provide context to the significance of this ordinarily machines of a similar nature to the machine 100 are provided with radial bearings on either side of the rotor. In some embodiments of the machine 100 radial bearing may also be deployed on either side of the body 102. However significantly the provision of such bearings is not essential so that other embodiments of the machine 100 may be constructed and operate with the same efficiency without such bearings; relying instead on the mutually facing surfaces of the bodies 102 and 104 to perform the function of the otherwise provided radial bearing. This may reduce the manufacturing cost and weight of the machine 100 and well as reducing the parts count and possible failure modes.

Figure 4:
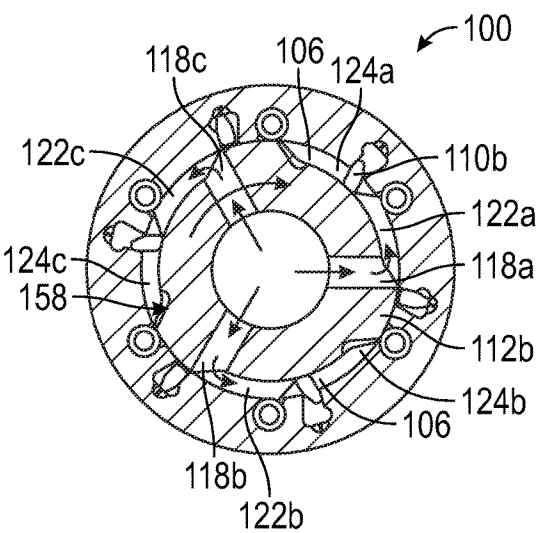
FIG. 4 is a view of section A-A of the machine shown in FIG. 2.
Figure 7:
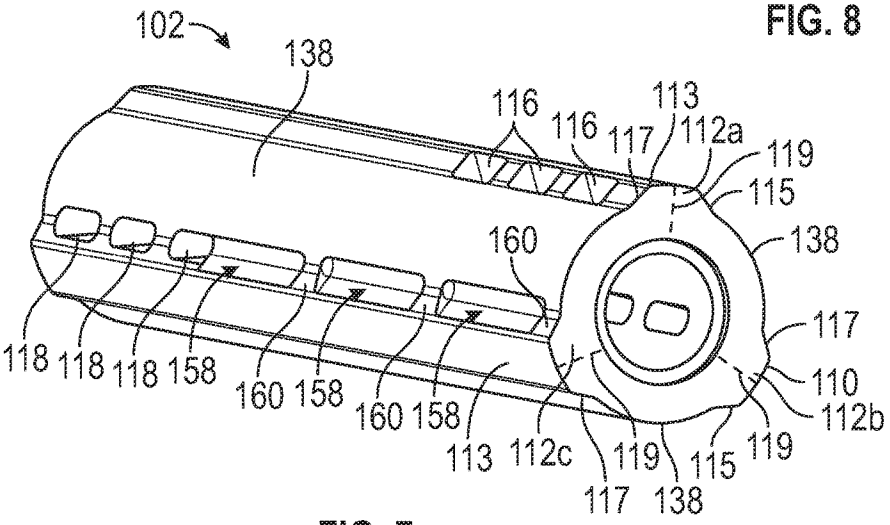
FIG. 7 is a perspective view of an inner body incorporated in the machine shown in FIG. 2.
Figure 6:
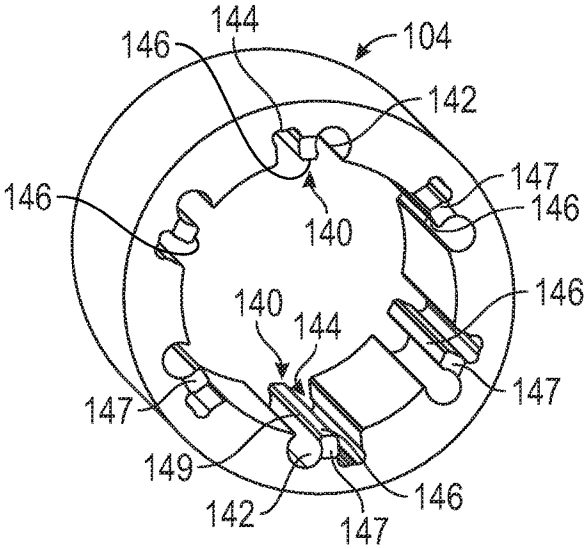
FIG. 6 is a perspective view of an outer body incorporated in the machine shown in FIG. 2.

With particular reference to FIGS. 4 and 7 the non-supporting body 102 is provided with a plurality of pressure equalisation recesses 158 on each leading side of a lobe 112 in axial alignment with the exhaust ports 118. The recesses 158 are separated by ramps 160 which follow the contour of the leading edge of the lobes 112. The ramps 160 provide surfaces on which the sealing portions 128 and in particular the surfaces 136 ride up on relative rotation between the bodies 102 and 104. The recesses 158 assist in balancing pressure across the gates 110 and in particular the sealing portion 128 as the gates ride up the leading edge of the lobes 112 and the exhaust ports 118. It will be appreciated that during relative rotation as a lobe 112 approaches a gate 110 the corresponding low pressure chamber 124 is reducing in volume while the high pressure chamber 122 on an opposite side of the gate has an increasing and relatively large volume. The fluid in the high pressure chamber must be vented efficiently to the exhaust ports 118 in a relatively short time period to prevent the build-up of excessive fluid pressure. This is achieved by the recesses 158 that assist in conveying high pressure fluid from portions of the high pressure chamber 122 into an adjacent low pressure chamber 124 in regions axially distant from the physical location of the outlet ports 118.

Depending on the application of the machine 100 opposite ends thereof will be either closed by annular end plates, or other components of a larger system or device in which the machine 100 is incorporated. For example, the machine 100 can be used as a direct substitution for the rotary fluid drive (110) in the bearing assembly (100) and in the down hole motor (500) described in Applicant's co-pending international application no. PCT/AU2013/000432. In such applications the present machine 100 is connected at the end comprising the inlet flow path Fi to a lower end of a bent housing which incorporates a fixed or an adjustable bent sub for a directional drill. An opposite end of the present machine 100 which incorporates the outlet flow path Fo is coupled with a mandrill and via various bearings to a drill bit.

However, embodiments of the machine 100 are not limited to use in directional drill systems and may be used as stand-alone devices such as a drive when fed with a high pressure fluid to provide torque to another machine; or as a pump when one of the bodies 102, 104 is driven relative to another. Further, in terms of the salient aspects of the machine 100 it is irrelevant which of the housings 102 and 104 rotates and which is stationary, and which one is the supporting body and which is the non-supporting body. These aspects have no bearing on the configuration and operation of the gates 110, gate pockets 140 and the lobes 112.

With reference to FIGS. 2 and 10 when the machine 100 is used as a pump: (a) the non-supporting body 102 rotates in the counter clockwise direction (depicted by phantom arrow 170 in FIG. 10); and (b) the suction side is at the downhole end 172 and the pressure side at the up hole end 174. In this pump embodiment fluid enters the machine via ports 118 and leaves via ports 116. This flow direction is opposite to that depicted by the flow path Fo and Fi in FIG. 2. In this embodiment mandrel coupled to the non-supporting body 102 must be driven by an outside power source such as directly coupled to an inline motor or engine or via a belt, gear train connected to the end to the rotor. If used as a substitute for the machine in application no. PCT/AU2013/000432 a belt, gear train, or direct coupling method could drive the mandrel (10) to provide the power to turn the rotor counter clockwise. In this case a lobe 112 passes the swing axis of a gate 110 first and then passes the sealing portion 128 of that gate 110.

Whilst a specific embodiment of the machine 100 has been described, it should be apparent that the machine 100 may be embodied in many other forms.

Figure 11:
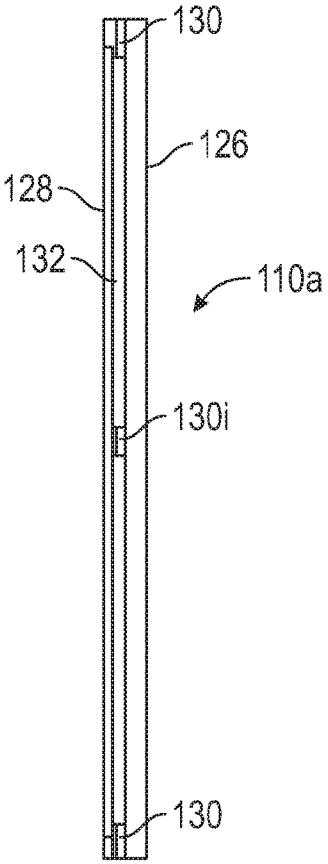
FIG. 11 is a front elevation of an alternate form of gate that may be incorporated in the machine.
Figure 12:
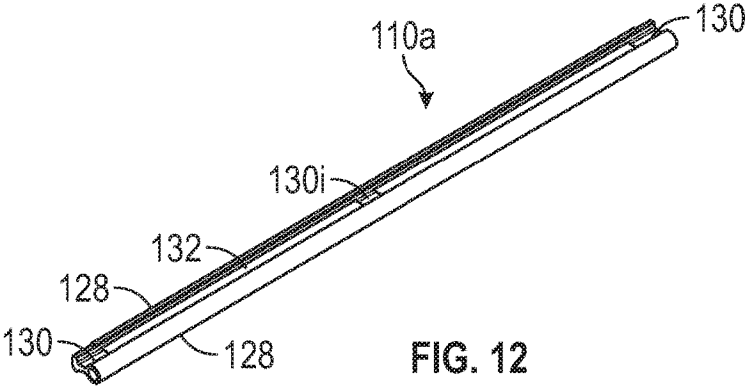
FIG. 12 is a perspective view of the gate shown in FIG. 11.
Figure 13:
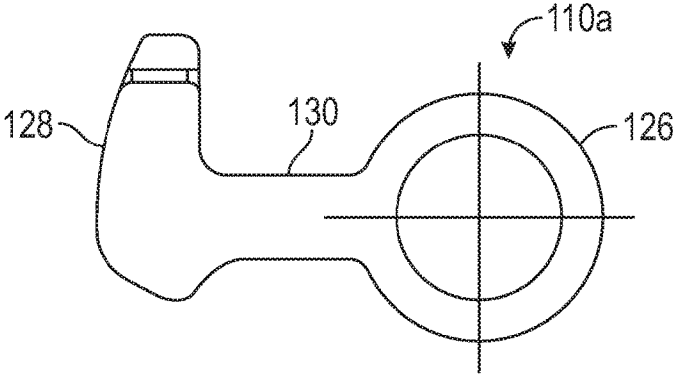
FIG. 13 is an end view of the gate shown in FIGS. 11 and 12.

For example in the present embodiment the inlet ports 116 and outlet ports 118 are separated by a physical barrier in the form of a wall 120 in the body 102. However in alternate embodiments, a flow control mechanism may be placed in the wall 120 to provide a bypass for at least a portion of the fluid to the working chamber 106. In this event at least some of the fluid can flow directly from the inlet flow path Fi to the outlet flow path Fo for example in the event of an overpressure condition. Further, while the inlet ports 116 and 118 are axially spaced from each other along the length of the body 102 in an alternate arrangement, the ports 116 and 118 may be provided along the entire length of the body 102 but fluidically separated by a manifold of the type described in U.S. Pat. No. 6,976,832. In another variation the lobes 112 may be configured to be symmetrical about its radial line 119. Also in other embodiments the gate may take other physical forms as depicted for example by gate 110*a* in FIGS. 11-13. In FIGS. 11-13 the same reference numbers are used to denote the same of similar features shown and described in relation to the gate 110 of FIG. 8. The gate 110*a* differs from gate 110 in essence by the addition of a third arm 130*i* located between arms 130 at each of the opposite ends of the gate 110*a*. The third arm 130*i* provides increase mechanical strength and rigidity to the sealing portion 128. This assists in preventing or minimizing bending of the sealing portion 128. In order to accommodate the gate 110*a* modifications are also required to the supporting housing 104. In particular an intermediate cut out is required in each of the lands 146 and corresponding projection 147 to provide space for the intermediate arm 130*i* when the gate 110*a* swings between its retracted and extended positions. An example of a cut out 149 is shown in phantom line in FIG. 6 for the land 146 and projection 147 at the six o'clock position only. Naturally if gate 110*a* is used instead of gate 110 then each of the lands 146 and projections 147 will require equivalent cut outs.

In the claims which follow, and in the preceding description except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the machine 100 as disclosed herein.

The invention claimed is:

1. A concentric rotary fluid machine comprising:

first and second bodies, the bodies being coaxially arranged one inside the other to define a working chamber there between and wherein the bodies are rotatable one relative to the other about a rotation axis;

at least one gate supported by one of the first body and the second body wherein the body supporting the gate constitutes a supporting body and the body not supporting the gate constitutes a non-supporting body;

at least one lobe provide on the non-supporting body; and for each gate, a respective gate pocket formed on the supporting body;

each gate being supported in a manner to swing about a respective swing axis that lies parallel with the rotation axis, each gate having a sealing portion distant its corresponding swing axis, each gate pocket being configured to receive the sealing portion of a corresponding gate; the gate pockets, sealing portions and non-supporting body being relatively configured such that when the at least one gate is in an extended position the sealing portion of the at least one gate forms a substantial seal against both the gate pocket and the non-supporting body wherein for each gate, the sealing portion is configured to always at least partially reside within a respective gate pocket during rotation of the bodies relative to each other;

wherein the gate pocket comprises a gate retention recess through which the swing axis passes and a gate seal recess within which the gate seal always at least partially resides during rotation of the bodies relative to each other;

wherein the supporting body comprises, for each gate pocket, a land located between the gate retention recess and gate seal recess.

2. The concentric rotary fluid machine according to claim 1 wherein each land and the non-supporting body are configured to form a substantial seal when a lobe is in radial alignment with a land.

3. The concentric rotary fluid machine according to claim 1 wherein each gate comprises a retention portion configured to be retained within the gate pocket and through which the swing axis passes and two or more arms that join the retention portion to a respective sealing portion wherein a space is created between the retention portion and the sealing portion.

4. The concentric rotary fluid machine according to claim 1 wherein each gate comprises a retention portion configured to be retained within the gate retention recess and two or more arms that join the retention portion to a respective sealing portion wherein a space is created between the retention portion and the sealing portion.

5. The concentric rotary fluid machine according to claim 4 wherein the land is accommodated within the space when a corresponding gate is in a retracted position with a lobe in radial alignment with the land.

6. The concentric rotary fluid machine according to any one of claims 1 to 5 wherein: when the machine is operated as a motor the direction of rotation of each about the corresponding swing axis to retract the gate into the respective gate pocket from the extended position is the same as the direction of rotation of the non-supporting body relative to the supporting body about the rotation axis; and when the machine is operated as a pump the direction of rotation of each about the corresponding swing axis to retract the gate into the respective gate pocket from the extended position is opposite to the direction of rotation of the non-supporting body relative to the supporting body about the rotation axis.

7. The concentric rotary fluid machine according to any one of claim 1 wherein, with reference to a direction of rotation of the non-supporting body relative to the supporting body about the rotation axis: when the machine is operated as a motor each gate is arranged so that the corresponding sealing portion is in advance of the corresponding swing axis such that one of the at least one lobe passes the sealing portion of the gate before passing the swing axis of the gate; and when the machine is operated as a pump each gate is arranged so that the corresponding sealing portion trails the corresponding swing axis such that one of the at least one lobe passes the corresponding swing axis of the gate before passing the sealing portion of the gate.

8. A concentric rotary fluid machine comprising:

first and second bodies, the bodies being coaxially arranged one inside the other to define a working fluid space there between and wherein the bodies are rotatable one relative to the other about a rotation axis;

at least one gate supported by one of the first body and the second body wherein the body supporting the gate constitutes a supporting body and the body not supporting the gate constitutes a non-supporting body;

at least one lobe provide on the non-supporting body;

each gate being supported in a manner to swing about a respective swing axis that lies parallel with the rotation axis, each gate having a sealing portion distant its corresponding swing axis, each gate and the bodies being relatively configured such that when the at least one gate is in an extended position the sealing portion forms a substantial seal against both the supporting and non-supporting body and wherein the gates and lobes are arranged such that on relative rotation of the bodies: when the machine is operated as a motor, a leading ramp of the lobes contacts the sealing portion of the at least one gate prior to passing a corresponding swing axis of the at least one gate; and when the machine is operated as a pump, a leading ramp of the lobes passes the swing axis of the at least one gate prior to contacting a corresponding portion of the at least one gate.

9. The concentric rotary fluid machine according to claim 8 comprising a gate pocket formed in the supporting body for each gate, wherein: when the machine is operated as motor the direction of rotation of a gate about a corresponding swing axis to retract the gate into the gate pocket from the extended position is the same as the direction of rotation of the non-supporting body relative to the supporting body about the rotation axis; and when the machine is operated as pump the direction of rotation of a gate about a corresponding swing axis to retract the gate into the gate pocket from the extended position is opposite the direction of rotation of the non-supporting body relative to the supporting body about the rotation axis.

10. The concentric rotary fluid machine according to claim 9 wherein each gate comprises a retention portion configured to be retained within the gate pocket and through which the swing axis passes and two or more arms that join the retention portion to a respective sealing portion wherein a space is created between the retention portion and the sealing portion.

11. The concentric rotary fluid machine according to claim 10 wherein each gate pocket comprises a retention recess in which the retention portion is received and a gate seal recess within which the sealing portion always at least partially resides during rotation of the bodies relative to each other.

12. The concentric rotary fluid machine according to claim 11 wherein the supporting body comprises, for each gate pocket, a land located between the gate retention recess and gate seal recess.

13. The concentric rotary fluid machine according to claim 12 wherein each land and the non-supporting body are configured to form a substantial seal when a lobe is in radial alignment with a land.

14. A concentric rotary fluid machine comprising:

first and second bodies, the bodies being coaxially arranged one inside the other to define a working fluid space there between and wherein the bodies are rotatable one relative to the other about a rotation axis;

at least one gate supported by one of the first body and the second body wherein the body supporting the gate constitutes a supporting body and the body not supporting the gate constitutes a non-supporting body;

at least one lobe provide on the non-supporting body;

each gate having a retention portion, and a distant sealing portion, the supporting body being provided with a gate pocket for each gate, each gate pocket having a retention recess for receiving the retention portion of a gate and a seal recess for receiving the sealing portion of the same gate and a land between the retention portion and the sealing portion; the lobes and lands being configured to form a substantial seal against each other when in mutual radial alignment.

15. The concentric rotary fluid machine according 17 wherein each gate comprises two or more arms that join the retention portion to a respective sealing portion wherein a space is created between the retention portion and the sealing portion.

16. The concentric rotary fluid machine according to claim 15 wherein for each gate pocket, the land is accommodated within the space when a corresponding gate is in a retracted position with a lobe in radial alignment with the land.

17. The concentric rotary fluid machine according to claim 1 wherein each lobe is sufficiently wide to form a substantial seal with a circumferential surface of the supporting body facing the working chamber across at least one of the seal recess and the retention recess.

18. The concentric rotary fluid machine according claim 1 wherein each lobe is sufficiently wide to form a substantial seal with a circumferential surface of the supporting body facing the working chamber across both of the gate seal recess and the gate retention recess at one particular instant in time.

19. The concentric rotary fluid machine according to claim 1 wherein each lobe has a profile that is symmetrical about a radial center line of the lobe.

20. The concentric rotary fluid machine according to claim 1 wherein each lobe has a profile that is assymmetrical about a radial center line of the lobe.

21. The concentric rotary fluid machine according to claim 1 wherein each gate pocket is provided with at first slot configured to provide clearance for the sealing portion of a corresponding gate to allow over-travel of each gate when contacted by a lobe.

* * * * *